US011286084B1

(12) United States Patent
Love et al.

(10) Patent No.: US 11,286,084 B1
(45) Date of Patent: Mar. 29, 2022

(54) DISPLAY SYSTEM OF INTERLOCKING UNITS

(71) Applicant: Vomela Specialty Company, St. Paul, MN (US)

(72) Inventors: Jeffry Richard Thomas Love, Savage, MN (US); Mark Andrew Williams, Stillwater, MN (US)

(73) Assignee: Vomela Specialty Company, St. Paul, MN (US)

( * ) Notice: Subject to any disclaimer, the term of this patent is extended or adjusted under 35 U.S.C. 154(b) by 167 days.

(21) Appl. No.: 16/449,958

(22) Filed: Jun. 24, 2019

Related U.S. Application Data

(60) Provisional application No. 62/689,399, filed on Jun. 25, 2018.

(51) Int. Cl.

| | |
|---|---|
| ***B65D 21/02*** | (2006.01) |
| ***A47B 87/02*** | (2006.01) |
| ***B65D 5/00*** | (2006.01) |
| ***G09F 15/00*** | (2006.01) |
| ***A47F 7/28*** | (2006.01) |

(52) U.S. Cl.
CPC ..... *B65D 21/0204* (2013.01); *A47B 87/0223* (2013.01); *A47F 7/283* (2013.01); *B65D 5/0015* (2013.01); *G09F 15/0068* (2013.01)

(58) Field of Classification Search
CPC ..... B65D 21/0204; B65D 21/0201; B65D 21/0216; B65D 21/0202; B65D 21/02; B65D 21/0212; B65D 21/0215
USPC ..... 206/511, 512, 503, 504, 506, 507, 508, 206/509, 513
See application file for complete search history.

(56) References Cited

U.S. PATENT DOCUMENTS

| | | | | |
|---|---|---|---|---|
| 2,319,924 | A * | 5/1943 | Ferguson | B65D 5/4295 229/120.1 |
| 4,192,562 | A | 3/1980 | Bishoff et al. | |
| 4,398,653 | A * | 8/1983 | Daloisio | B65D 90/205 108/53.1 |
| 4,573,595 | A | 3/1986 | Mednis | |
| 5,699,925 | A | 12/1997 | Petruzzi | |
| 5,853,091 | A | 12/1998 | Luenser | |
| 5,888,114 | A | 3/1999 | Slocum et al. | |
| 6,659,463 | B2 | 12/2003 | Mackey | |
| 6,935,504 | B2 | 8/2005 | Ritter et al. | |
| 7,150,360 | B2 | 12/2006 | Carlin et al. | |
| 7,160,052 | B2 | 1/2007 | Weiss, Jr. et al. | |
| 7,823,765 | B2 | 11/2010 | Weimer | |
| 7,980,956 | B2 | 7/2011 | Kneeshaw et al. | |
| 8,342,347 | B2 | 1/2013 | Hay | |
| 8,695,795 | B1 | 4/2014 | Huber | |
| 8,763,889 | B2 | 7/2014 | Weissbrod | |
| 9,290,300 | B2 | 3/2016 | Hendrickson et al. | |
| 9,403,338 | B2 | 8/2016 | Tuczek | |
| 9,422,086 | B2 | 8/2016 | Thom et al. | |

(Continued)

FOREIGN PATENT DOCUMENTS

| | | | |
|---|---|---|---|
| WO | 2016059560 | A1 | 4/2016 |

*Primary Examiner* — Jeffrey R Allen
(74) *Attorney, Agent, or Firm* — Haugen Law Firm PLLP

(57) ABSTRACT

An interlocking three dimensional display system is described that includes a plurality of interlocking units. The interlocking units are easily coupled together and may be coupled in multiple varied orientations utilizing various combinations of an upper and base unit. The interlocking units are easily collapsed and fold flat for transportation.

8 Claims, 16 Drawing Sheets

(56) References Cited

U.S. PATENT DOCUMENTS

| | | | | |
|---|---|---|---|---|
| 9,492,734 | B2 | 11/2016 | Boulding | |
| 9,522,761 | B2 | 12/2016 | Baker et al. | |
| 9,761,068 | B2 | 9/2017 | Salmon et al. | |
| 9,796,498 | B2 | 10/2017 | Wintermute et al. | |
| 2003/0173875 | A1 | 9/2003 | Saravis | |
| 2006/0169691 | A1 | 8/2006 | Rothschild et al. | |
| 2006/0261063 | A1 | 11/2006 | Dyehouse | |
| 2009/0242496 | A1 | 10/2009 | Houssian | |
| 2015/0001119 | A1 * | 1/2015 | Wang ..... | B65D 90/0006 206/503 |
| 2017/0020251 | A1 | 1/2017 | Rothschild et al. | |
| 2017/0166347 | A1 | 6/2017 | Couture | |

* cited by examiner

DISPLAY SYSTEM OF INTERLOCKING UNITS

CROSS-REFERENCE TO RELATED APPLICATIONS

This application claims priority to U.S. Provisional Patent Application Ser. No. 62/689,399, filed on Jun. 25, 2018, the contents of which is being incorporated herein by reference in its entirety.

FEDERAL SPONSORSHIP

Not Applicable

JOINT RESEARCH AGREEMENT

Not Applicable

TECHNICAL FIELD

The present invention relates generally to portable three dimensional, collapsible displays, and more particularly relates to a stackable cube display that utilizes a plurality of interlocking members. The interlocking cubes of the invention are easily coupled together and may be coupled in multiple varied orientations utilizing various combinations of an upper and lower cubes.

BACKGROUND

Exhibit displays for meetings, trade shows, and other events typically include structures that are easily collapsible, transported and erected for the intended temporary usage. Such portable exhibit displays may commonly employ a network of flat, thin, banners or panels that interconnect together to form an aesthetically pleasing display or booth. Other posters or printed sheets may be hung to further draw the attention of the consumer to the display or booth. These panels or banners are often used to divide space apportioned to vendors, however the space within the booth is often left open and empty.

In the past, vendors have used merchandise and tables to fill the empty void in the booth area. Since consumers may first observe the booth and the displays within the booth from many different vantage points it is preferable to have multi-dimensional displays to catch the eye of the consumer. Further, it may be desirable to include indicia on multiple sides of the multi-dimensional displays. Although cardboard props have been as advertisements or displays, the present invention provides interchangeable, interlocking, multi-dimensional, multi-faced displays, such as for example cardboard cubes, which are easily stacked and collapsed. Also, it may be desirable to mix and match the messages or indicia printed on the multi sides of the interlocking cubes of the present invention. Although prior props may be positioned within a booth space or retail floor space these props are is easily disturbed and may require time to re-assemble. It is desirable to provide a collapsible, interlocking, multi-dimensional display that may be stacked to create a seamless appearance.

SUMMARY

Embodiments according to aspects of the invention are capable of stacking form a collapsible display system having interlocking units. A stacking unit of the present invention includes a three dimensional body, corner pillars extending upward from an upper edge of the three dimensional body, and tabs extending inward from the corner pillars. The three dimensional body has sides and a top and bottom. In an embodiment of the invention, the three dimensional body is cubic in shape and includes a front, back and interconnecting opposing sides, wherein the interconnecting opposing sides interconnect the front and back. The top end of the three dimensional body has at least four corner pillars extending upward and inward from a top edge of the top end of the three dimensional body. Those skilled in the art will appreciate that the three dimensional body may include other shapes and cross sectional shapes, including without limitation, a cylinder, polygon, or hexagon. The corner pillars may be spaced apart on the top edge of the three dimensional body and the shape of the four corner pillars may be modified to interlock with the shape of the three dimensional body.

Additionally, embodiments of the stackable unit in accordance with the present invention may include corner pillars having enclosed top ends. A plurality of units may be stacked together wherein the sides or faces of the stacked units are offset by approximately 45 degrees. The top edge of a first unit engages with a base or lower edge of a second unit and a lower portion of the sides of the second unit engage with an inner side of the pillars. The bottom portion of each of the front, back and interconnecting opposing sides of the second unit may have a slot formed therein such that the slots are adapted to receive tabs of the first unit. When slots are present, the tabs and slots interlock when the second unit is aligned and stacked onto the first unit. In an embodiment of the invention, the top of each pillar may be triangular in shape and alternatively the triangular shape may form an isosceles triangle. The plurality of three dimensional units may be formed from a flat sheet of cardboard, foam board, or other material suitable for display. Further, the flat sheets may be segmented dependent upon the overall size and desired shape of the units.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus of the present invention is particularly well suited for retail and trade show displays. Although the invention will be described in the context of a three dimensional cube those skilled in the art will appreciate that the novel concepts of the invention may be incorporated into other three dimensional shapes. The apparatus includes indicia on sides, or regions of the three dimensional object, such that an observer is able to view indicia on the various sides from certain vantage points but not others. The three dimensional cubes, for example, are stackable and include a locking feature that interlocks the stacked cubes. If the system of cubes is knocked over, the interlocking feature allows the entire system to be easily up righted rather than requiring a re-assembly and stacking of cubes. The interlocking feature is further located at corners of the cube so that in order to stack and interlock another cube above a lower cube, the upper cube must be rotated. The side faces of the lower cube and upper cube are offset and as more cubes are stacked and interlocked the alignment of the cubes gives an appearance of a helical stack of cubes. The interlocking feature aligns on the outside corners of the cube. When the cubes are stacked and interlocked the cube system provides an illusion that the interlock feature extends from both the bottom and top corners of the cube.

Figure 1:
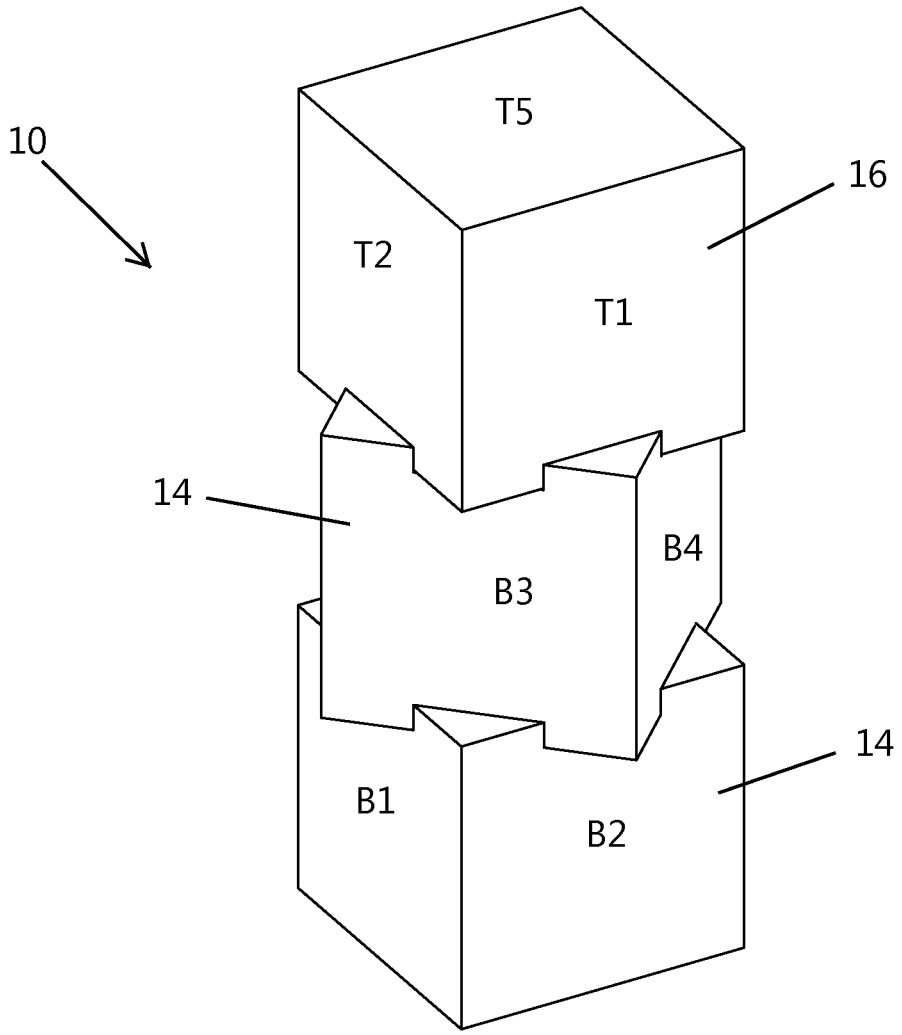
FIG. 1 is a top front perspective view of an embodiment of a display system of interlocking units of the present invention.
Figure 2:
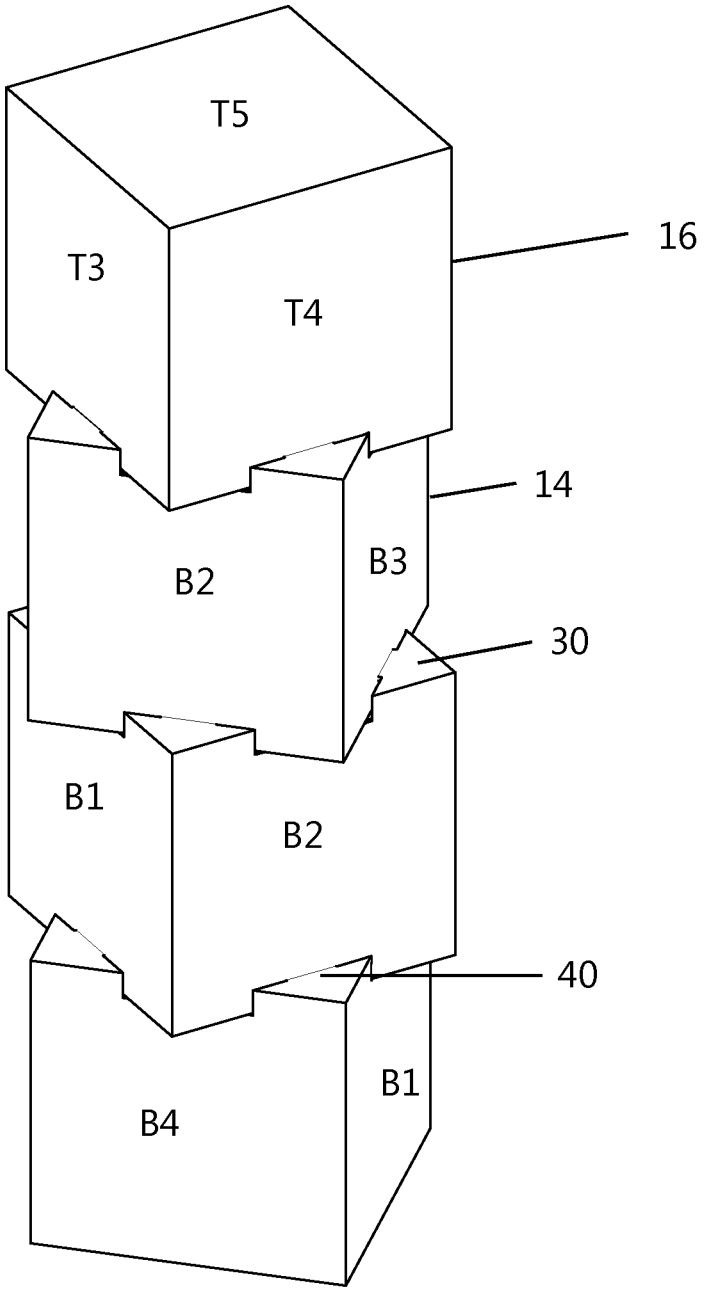
FIG. 2 is a top right side perspective view of the display system of interlocking units of the type shown in FIG. 1.
Figure 3:
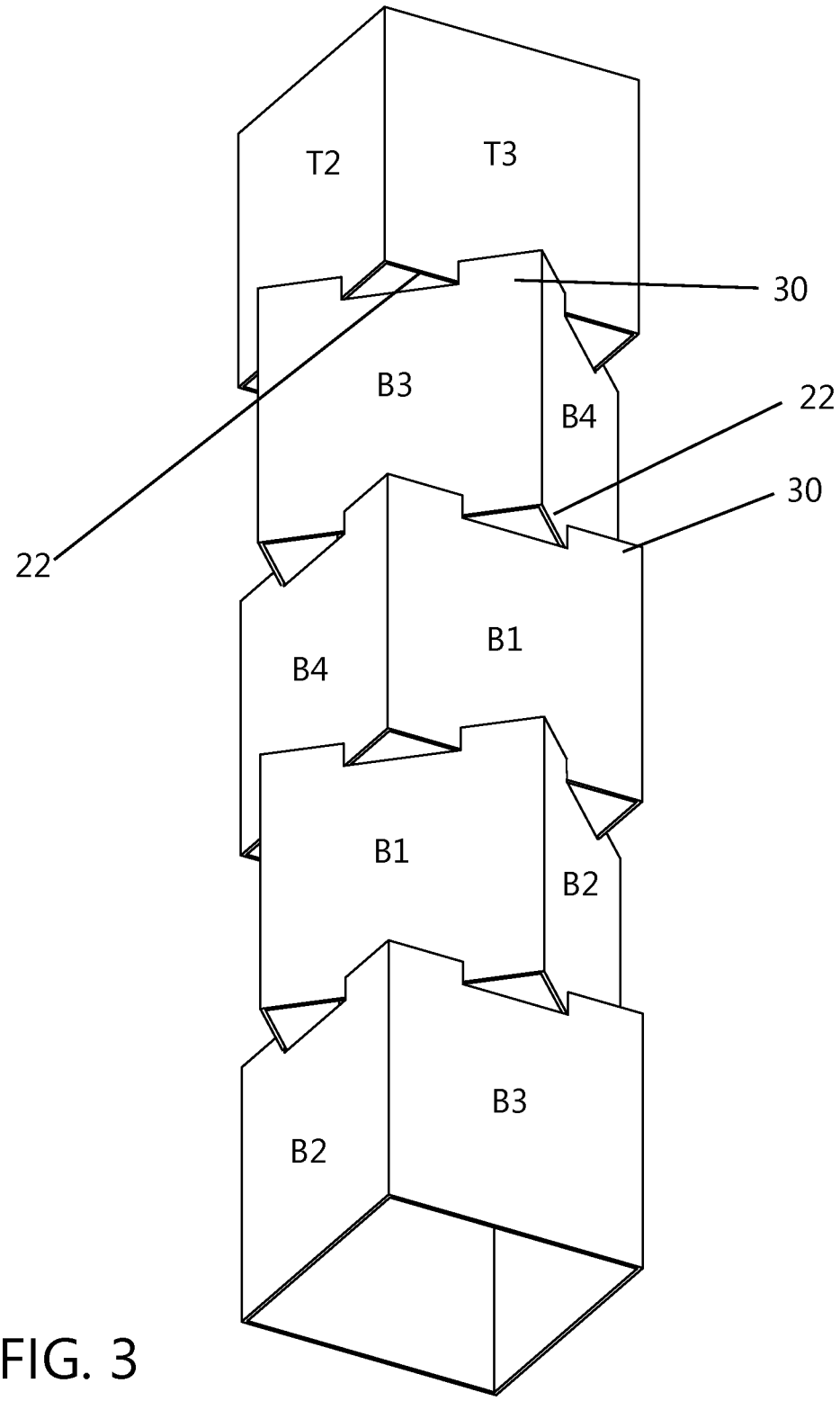
FIG. 3 is a lower left bottom side perspective view of the display system of interlocking units of the type shown in FIG. 1.

The display system apparatus 10 of the present invention generally includes two types of coupling units: a base unit 14 and a top unit 16. One or more base units 14 may be stacked and coupled together while a top or cap unit 16 is stacked and interlocked or coupled to the uppermost base unit 14. With reference to FIGS. 1-3 the display system 10 is shown including multiple base units 14 and a top unit 16 coupled together. The drawings illustrate indicia on or associated with the sides of the base units 14 and top unit 16 wherein the indicia is depicted as B1, B2, B3, B4, T1, T2, T3, T4, and T5.

Figure 4:
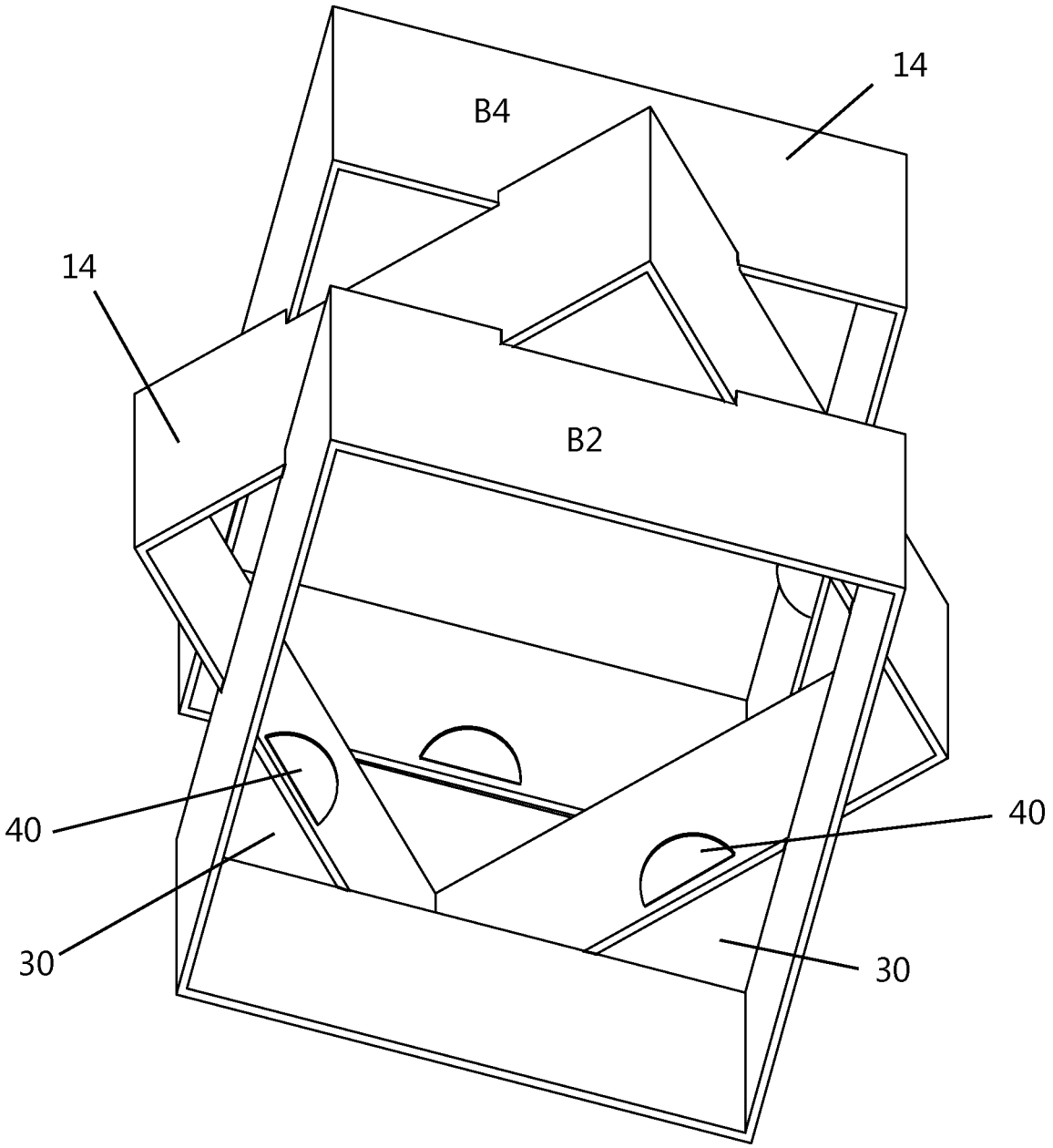
FIG. 4 is a bottom side perspective view of an embodiment of a display system of interlocking units of the present invention.
Figure 5:
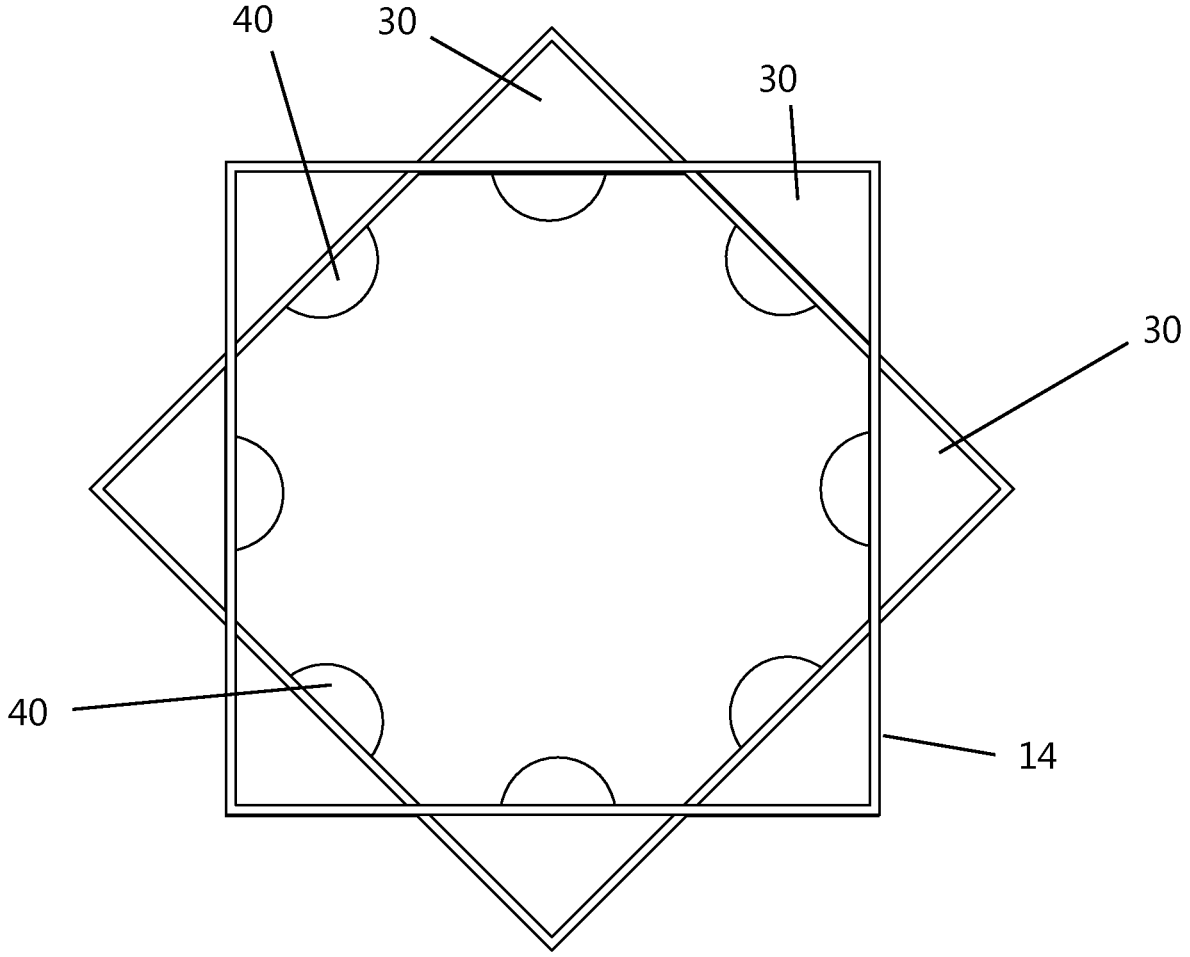
FIG. 5 is a bottom view of the display system of interlocking units of the type shown in FIG. 5.
Figure 6:
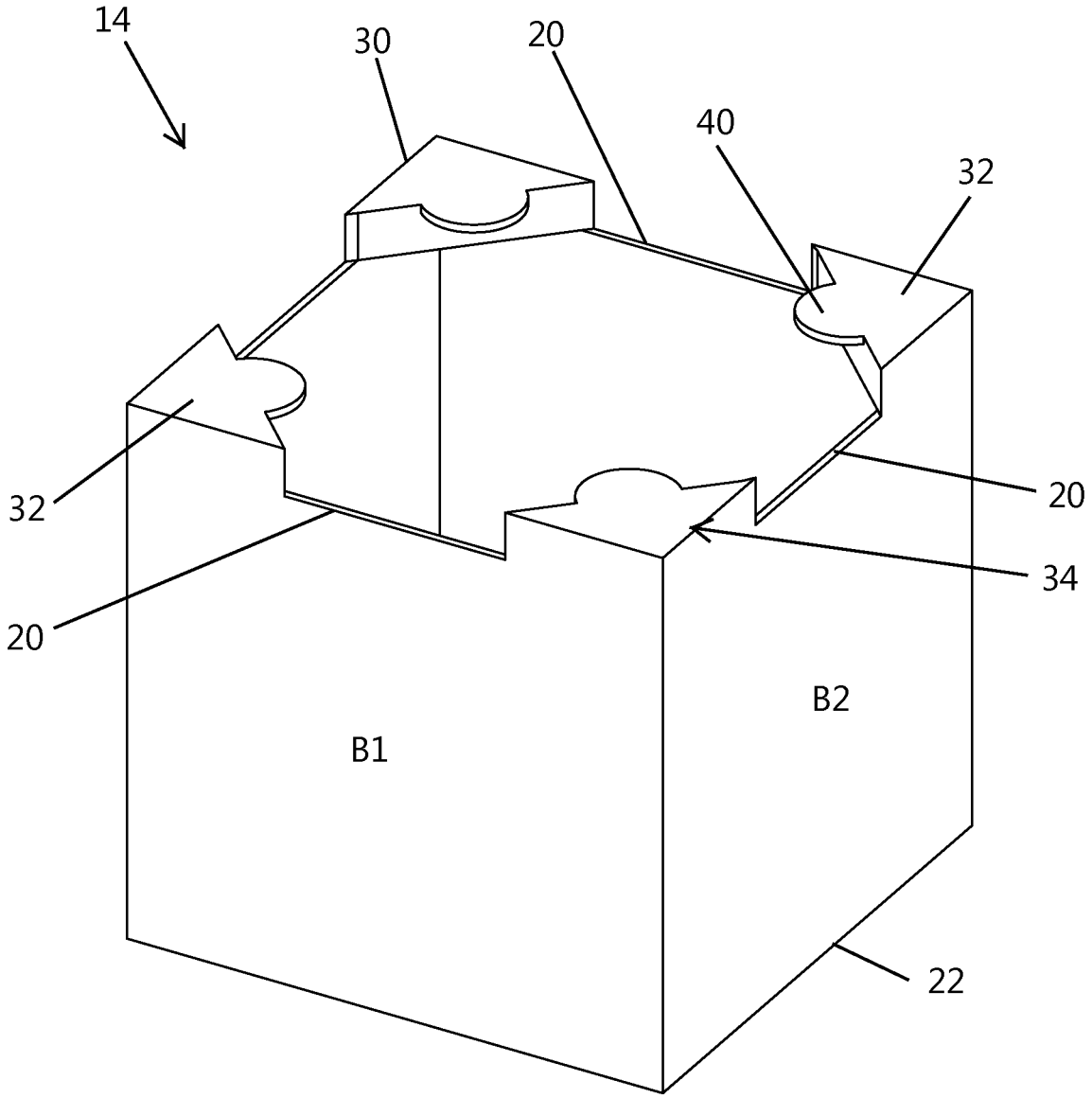
FIG. 6 is a top perspective view of a bottom or intermediate unit of interlocking units of the present invention.
Figure 7:
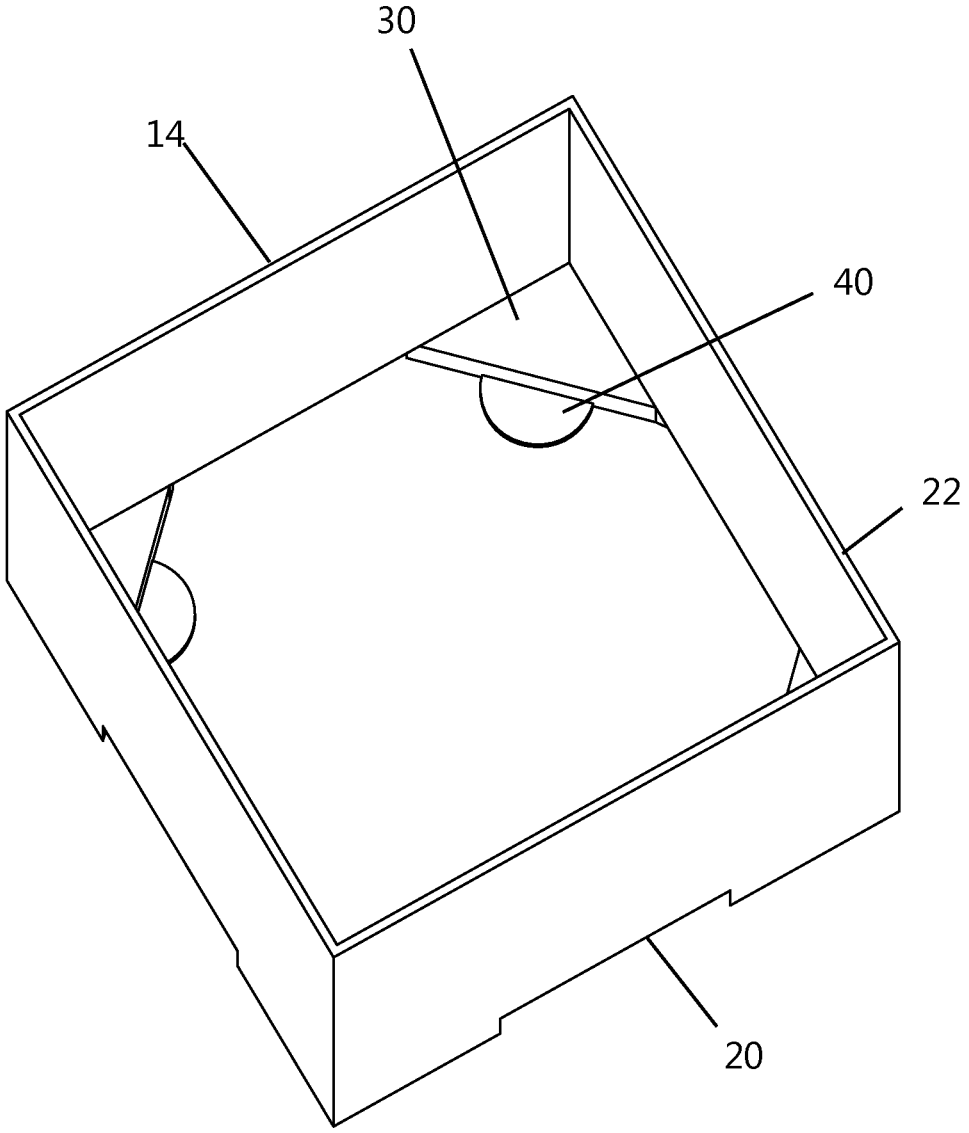
FIG. 7 is a bottom perspective view of the bottom or intermediate unit of interlocking units of the type shown in FIG. 7.
Figure 8:
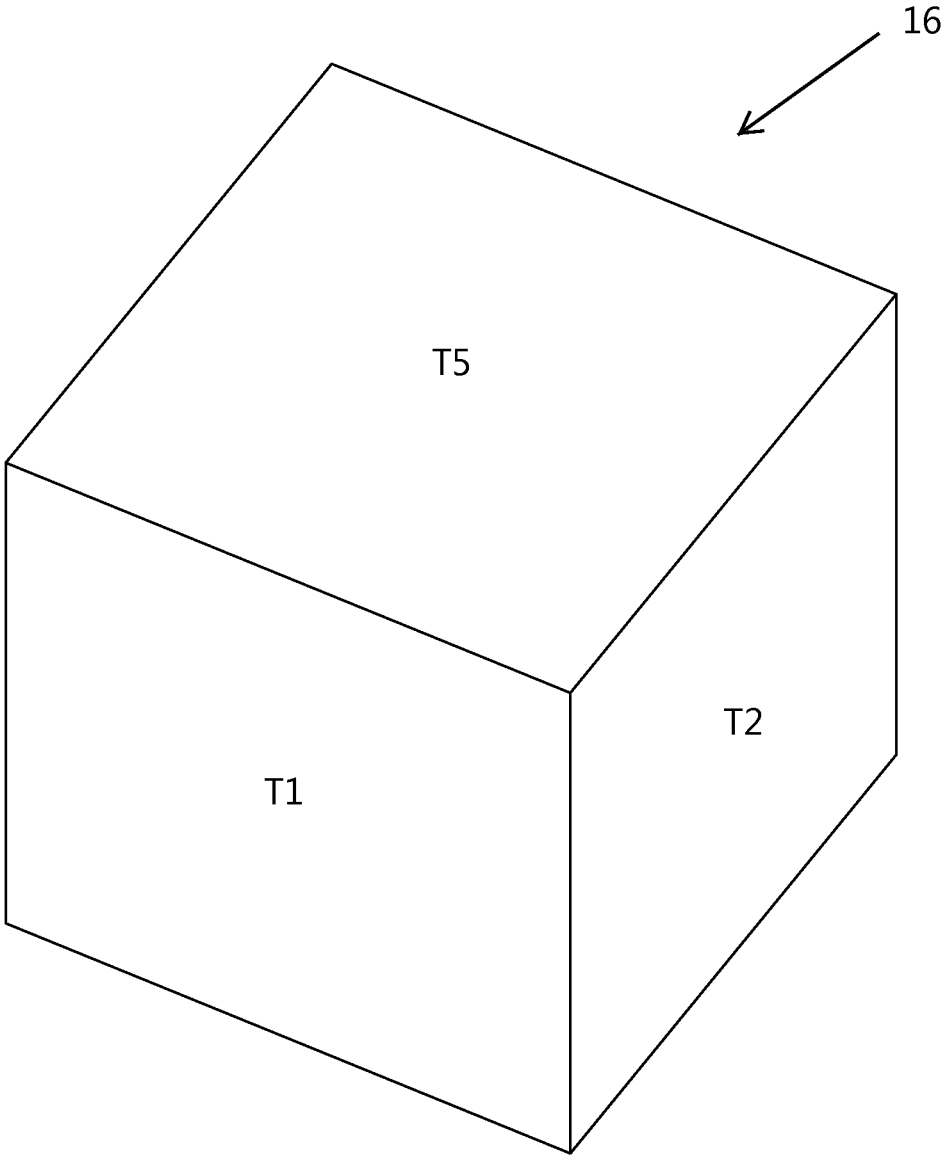
FIG. 8 is a top perspective view of a top unit of interlocking units of the present invention.
Figure 9:
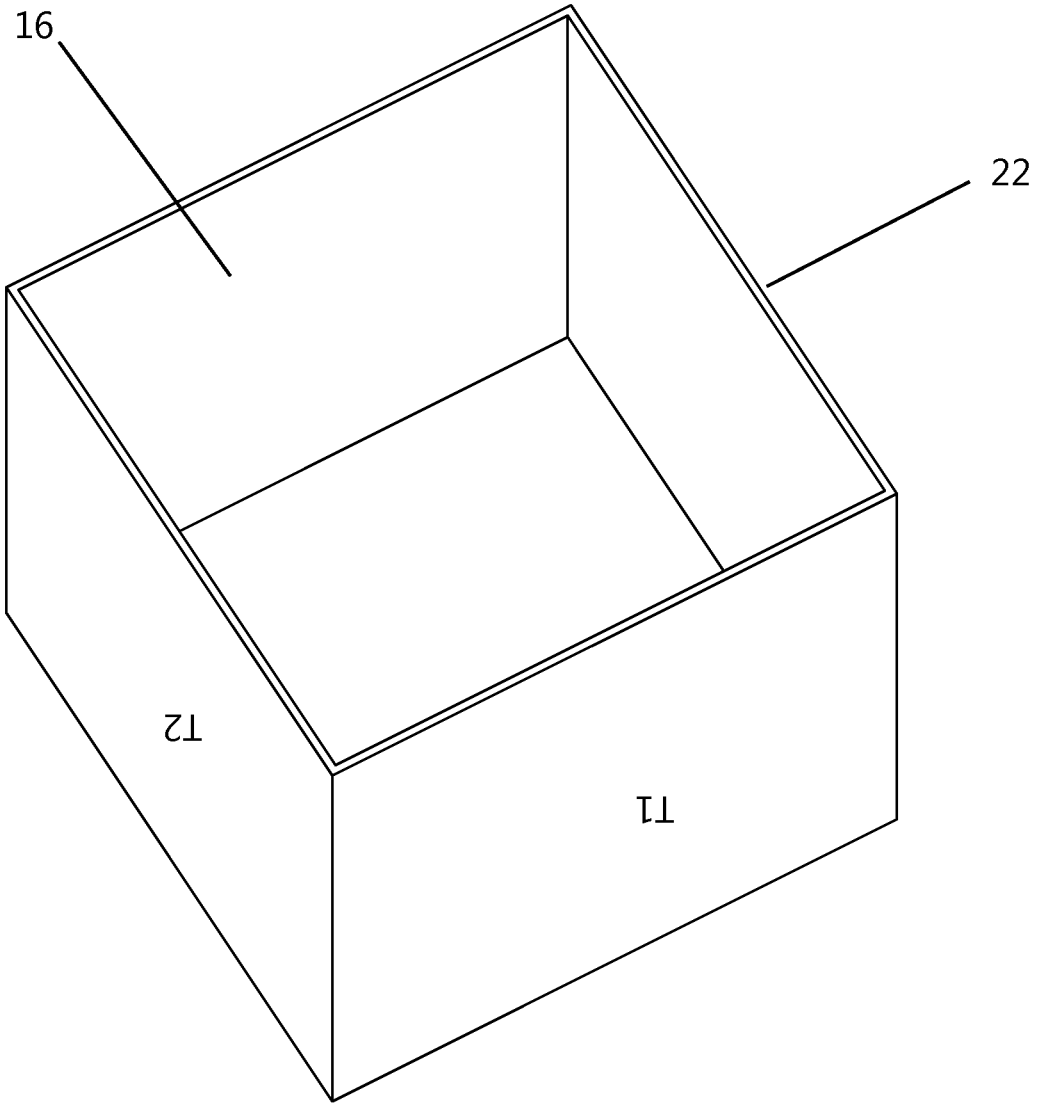
FIG. 9 is a bottom perspective view of the top unit of interlocking units of the type shown in FIG. 8.

As seen in FIGS. 4 and 5 the base unit 14 includes a three dimensional body having a front and back with opposing sides interconnecting the front and back, wherein each of the front, back and opposing sides have a top edge 20 and bottom edge 22. Pillars 30 extend upward and inward from the top edge 20 at each of the four corners of the three dimensional body of the base unit 14. The top 32 of each pillar may be an enclosed flat surface 32. The pillar 30 may extend inward to form a triangular shape 34 and the sides of the pillar may be equal in length to thereby form the pillar having a cross section of an isosceles triangle 36 (specifically a 45-45-90 right triangle). A tab 40 extends inward from each pillar 30 and is adapted to insert into a slot 50 formed into a bottom portion of each of the front, back and opposing sides of a second stacked base unit 14 (see FIGS. 8 and 9) or stacked top unit 16 (see FIGS. 6 and 7).

Figure 10:
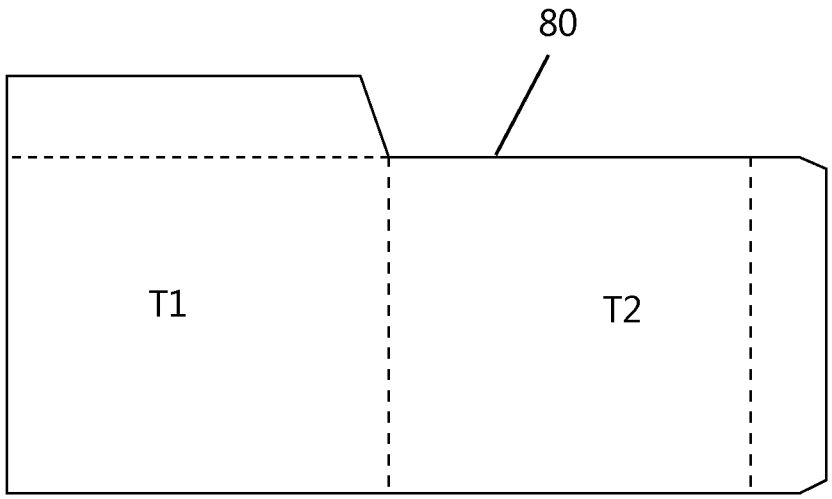
FIG. 10 is a front view of a first sheet segment of a top unit of the present invention.
Figure 11:
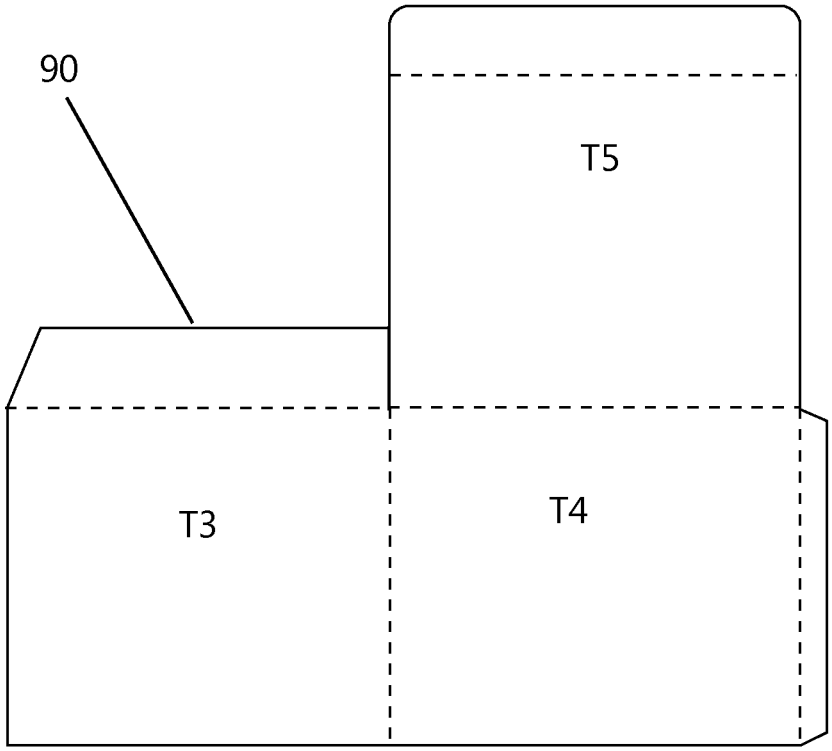
FIG. 11 is a front view of a second sheet segment of a top unit of the present invention.
Figure 12:
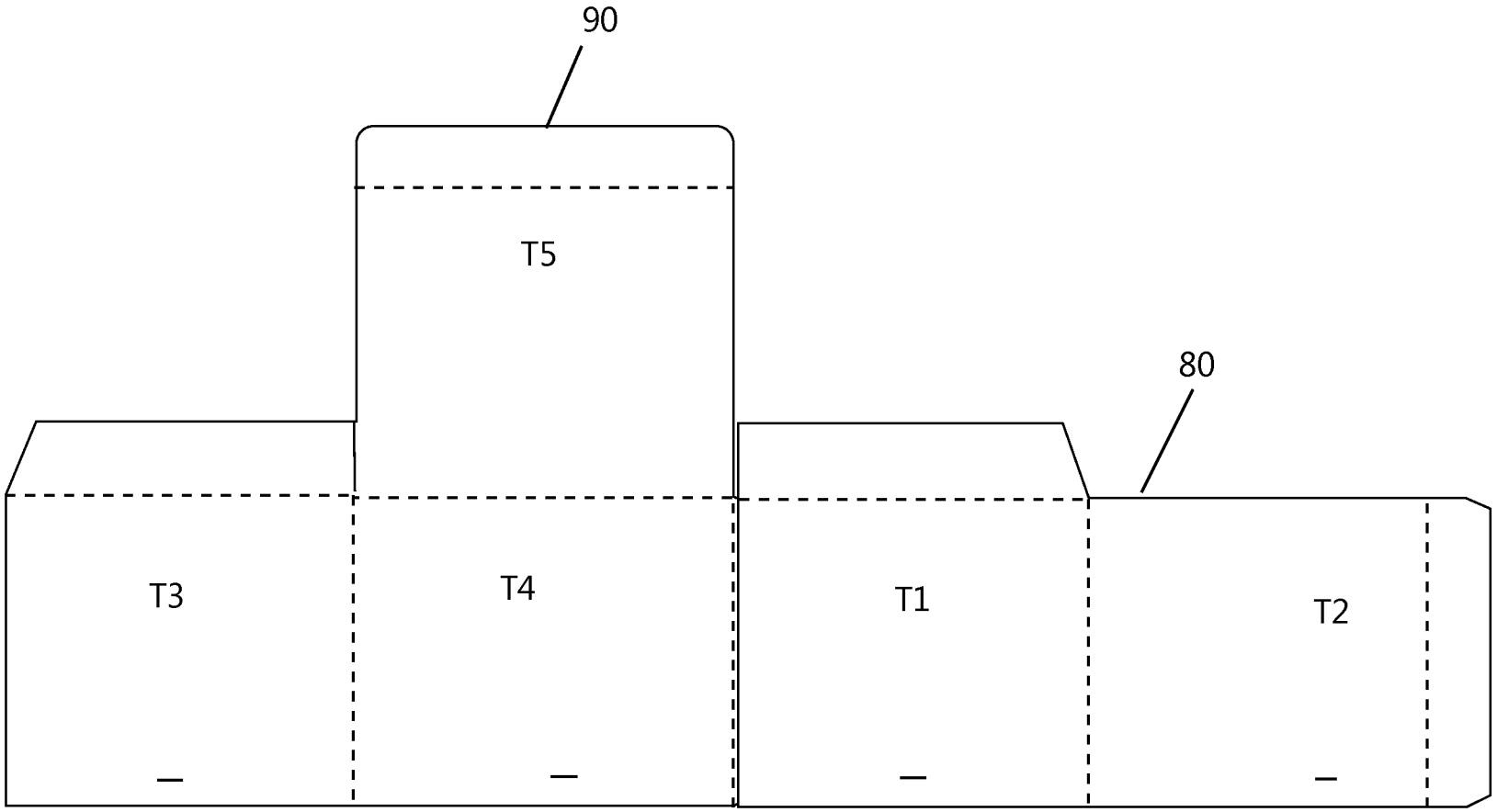
FIG. 12 is a front view of a combined first and second sheet segments of a top unit of the present invention.
Figure 13:
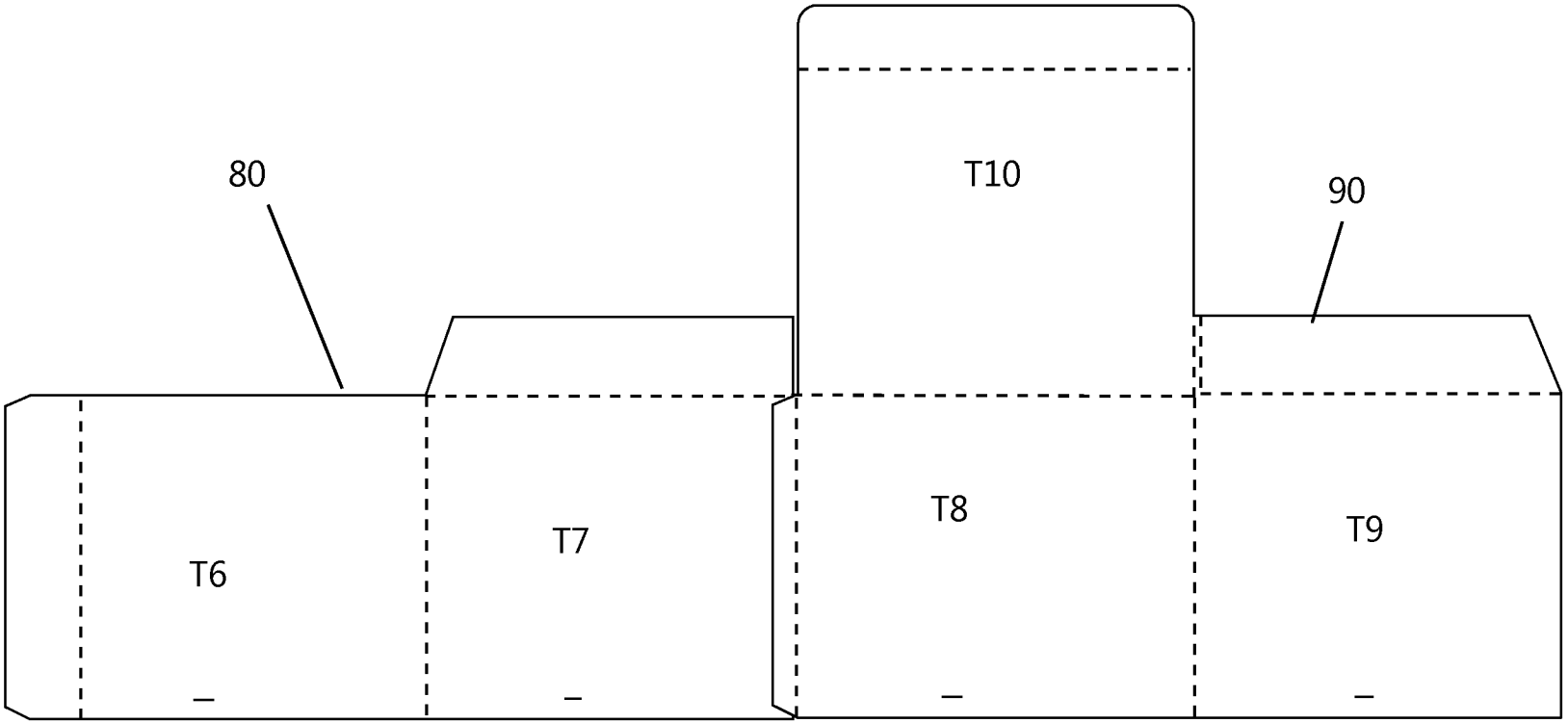
FIG. 13 is a back view of a combined first and second sheet segments of a top unit of the present invention.
Figure 14:
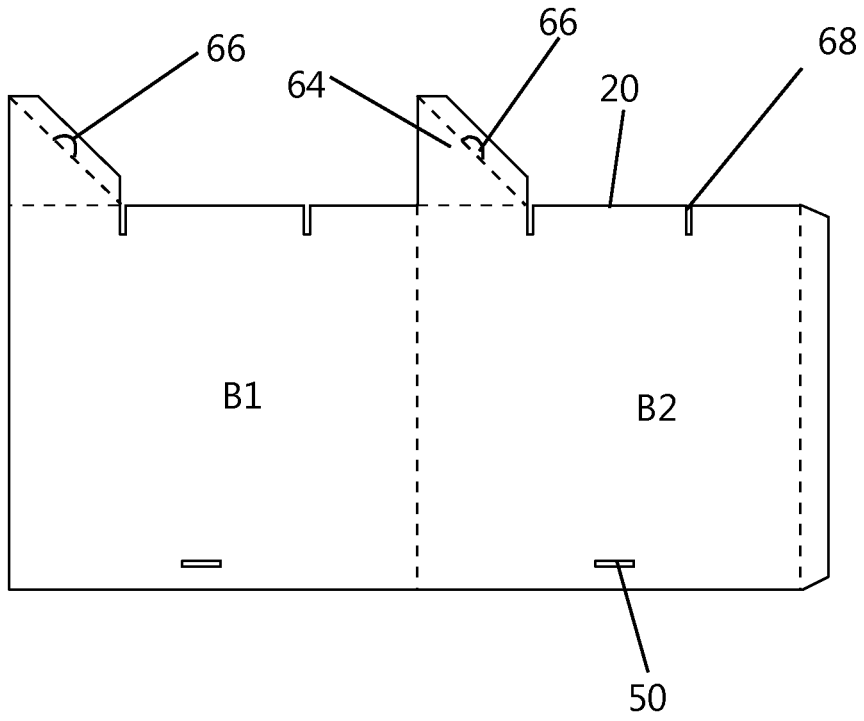
FIG. 14 is a front view of a sheet segment of a bottom or intermediate unit of the present invention.
Figure 15:
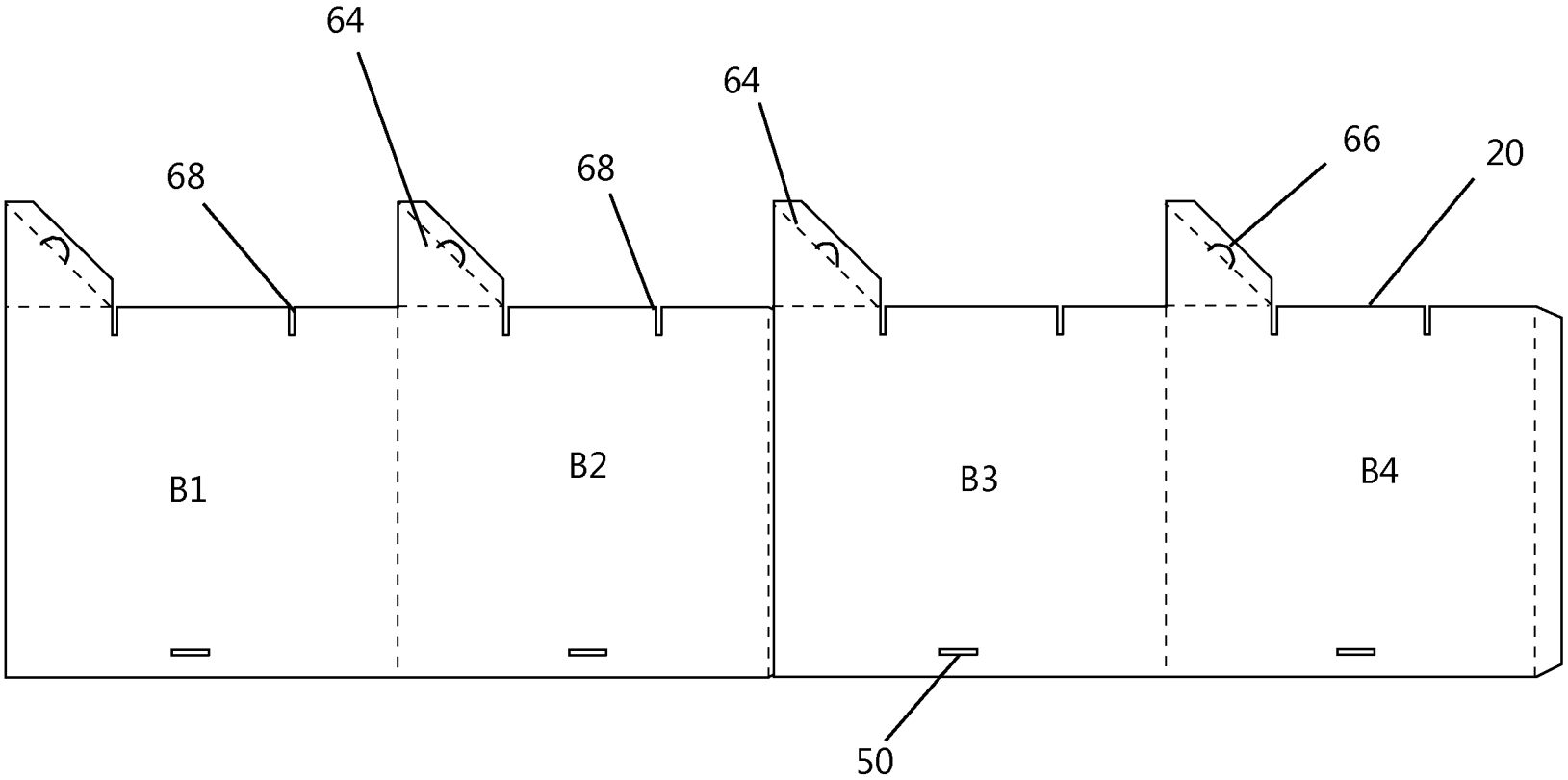
FIG. 15 is a front view of a combined first and second sheet segments of a bottom or intermediate unit of the present invention.
Figure 16:
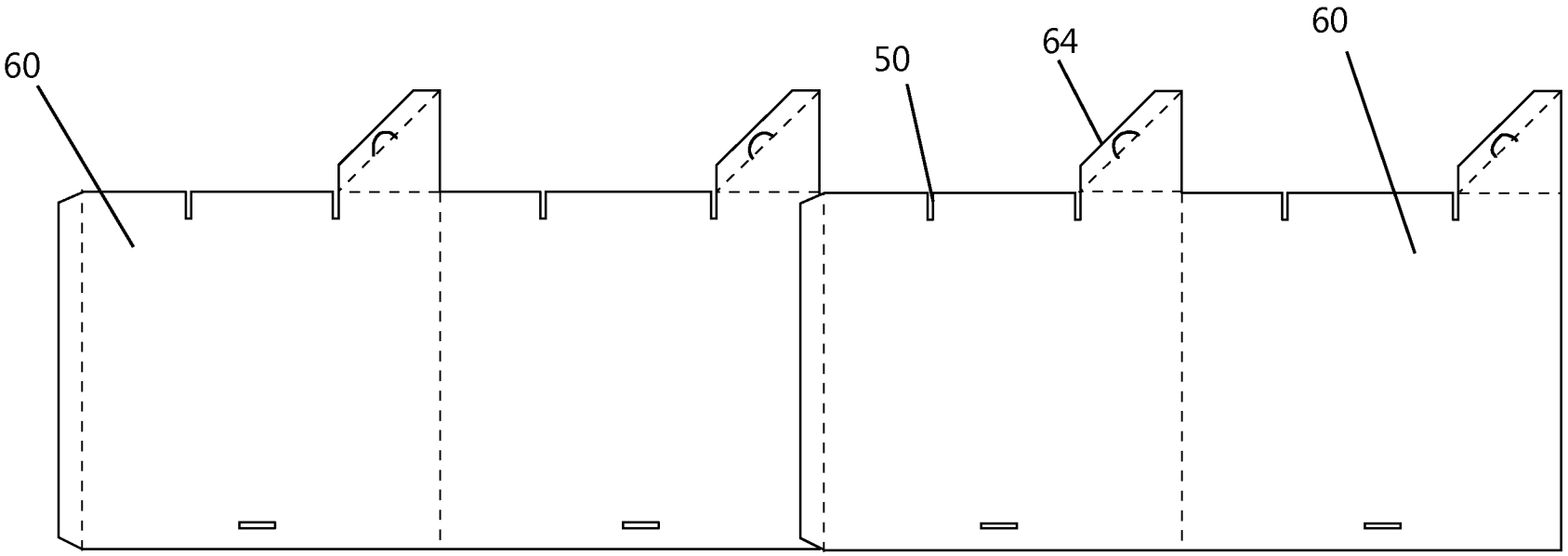
FIG. 16 is a back view of a combined first and second sheet segments of a bottom or intermediate unit of the present invention.

With reference to FIGS. 10-11 the cutouts of flat sheet material 80 and 90 are shown. When the two segments 80 and 90 are adhered together or combined (see FIGS. 12-13) and folded along the fold lines (broken lines) the top or cap unit 16 is formed having an open bottom and enclosed top. FIG. 14 illustrates the cutout of flat sheet material 60 that may be utilized to form the base unit 14. Two flat sheets 60 are adhered together as illustrated in FIGS. 15 and 16 and then folded along fold lines (broken lines) to form the base unit 14. The flat sheet 60 includes ears 64 that when folded along the fold line (broken line) form or create the triangular shaped pillar 30. Each ear 64 may include a semi-circular stamp or die cut 66 that, when the ear is folded along the fold line (broken line) the semicircular cutout extends from the pillar 30 and forms the tab 40. Slots 68 are formed in the top edge 20 of the base unit 14 and are adapted to receive a bottom portion of an adjacent stacked base unit. In this manner the stacked unit is interlocked by the pillars 30, tabs 40 and slots 68.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A display system, comprising:

a first interlocking body having a first sidewall defining an interior and an exterior of the first interlocking body, and an open top and open bottom, the first sidewall terminating in a first perimeter top edge and a first perimeter bottom edge, at least one of the first perimeter top edge and first perimeter bottom edge having a plurality of spaced apart first pillars extending therefrom together defining a plurality of recesses between adjacent ones of the first pillars, wherein the respective first perimeter top edge or first perimeter bottom edge including the first pillars forms a base of each recess, the first pillars each having an interior-facing surface and an interlocking tab extending interiorly from the interior facing surface of the pillar; and a second interlocking body having a second sidewall defining an interior and an exterior of the second interlocking body, the second sidewall terminating in a second perimeter top edge and a second perimeter bottom edge, and having a plurality of slots therein that are each configured to engageably receive a respective interlocking tab therethrough for securing the second interlocking body to the first interlocking body, the second sidewall being configured to engage the interior facing surface of the first pillars when the first and second interlocking bodies are stacked so that one of the second perimeter top edge and the second perimeter bottom edge contacts the base of at least one of the recesses wherein the containing second top edge or second bottom edge intersects and extends both interiorly and exteriorly beyond the respective base at an oblique angle.

2. The display system as in claim 1 wherein the first pillars extend into the interior of the first interlocking body.

3. The display system as in claim 2 wherein the first sidewall is shaped as a polyhedron, with the first pillars extending from respective corners formed at junctions between polyhedron sides of the first sidewall.

4. The display system as in claim 3 wherein the polyhedron is a cube.

5. The display system as in claim 4 wherein the first pillars form triangular prisms with the interior-facing surface being planar.

6. The display system as in claim 1 wherein the first and second interlocking bodies are stackable so that one of the second perimeter top edge and the second perimeter bottom edge contacts the base of each recess at the corresponding first perimeter top edge and first perimeter bottom edge.

7. The display system as in claim 6 wherein the interlocking tabs of the first interlocking body are engageable within respective slots of the second interlocking body when the first and second interlocking bodies are stacked so that one of the second perimeter top edge and the second perimeter bottom edge contacts the base.

8. The display system as in claim 1 wherein at least one of the second perimeter top edge and the second perimeter bottom edge of the second interlocking body includes a plurality of spaced apart second pillars extending therefrom together defining a plurality of recesses between adjacent ones of the second pillars, wherein the respective second perimeter top edge or second perimeter bottom edge forms a base of each recess.

* * * * *